United States Patent [19]

Leger

[11] 4,276,831

[45] Jul. 7, 1981

[54] TROLLEY STORAGE

[76] Inventor: Jean-Paul Leger, 5000-4e rue, Chomedey, Laval, Quebec, Canada

[21] Appl. No.: 9

[22] Filed: Jan. 2, 1979

[30] Foreign Application Priority Data

Jan. 6, 1978 [CA] Canada ..... 294510

[51] Int. Cl.[3] ..... E01B 25/22

[52] U.S. Cl. ..... 104/93; 104/100; 104/131

[58] Field of Search ..... 104/18, 20, 96, 99, 104/100, 103, 104, 130, 131

[56] References Cited

U.S. PATENT DOCUMENTS

| | | | |
|---|---|---|---|
| 1,684,986 | 9/1928 | Gillies | 104/99 |
| 3,144,836 | 8/1964 | Cripe et al. | 104/103 |
| 3,320,903 | 5/1967 | Knolle | 104/20 |
| 3,712,237 | 1/1973 | McElroy | 104/99 |
| 3,818,836 | 6/1974 | Swilley | 104/100 |

FOREIGN PATENT DOCUMENTS

| | | | |
|---|---|---|---|
| 683894 | 4/1964 | Canada | 104/96 |
| 620591 | 5/1961 | Italy | 104/130 |
| 7512076 | 4/1977 | Netherlands | 104/96 |

*Primary Examiner*—John J. Love
*Assistant Examiner*—Ross Weaver
*Attorney, Agent, or Firm*—McFadden, Fincham & Co.

[57] ABSTRACT

The present invention relates to an overhead trolley switching system which is operative in both manual and automatic modes. The switching system is particularly suited for the storage of overhead trolleys and includes a secondary rail spaced from the main rail along with a switching rail adapted to divert one wheel assembly from the main rail. The trolleys can, if desired, be stored in a diagonal position.

3 Claims, 14 Drawing Figures

TROLLEY STORAGE

The present invention relates to overhead trolleys and more particularly, relates to a trolley storage and switching system.

Overhead trolleys are employed in several industries and find particular use wherein goods or a garment must be transferred from a first work station to one or more subsequent work stations and/or storage areas. The garment and textile industry is one example wherein overhead trolleys are widely used. Examples of trolleys employed are in Canadian Pat. Nos. 206,541 issued Dec. 14, 1920 to Neller and 993,394 issued July 20, 1976 to Wilson.

It is an object of the present invention to provide a switching arrangement for overhead trolleys. In particular, it is an object of the present invention to provide a switching system for overhead trolley storage which is automatic and which will store individual trolleys in either a diagonal or straight-line configuration.

According to one aspect of the present invention, there is provided a trolley storage system which includes a main rail upon which one or more trolleys are adapted to ride. A secondary rail is adapted to act in cooperation with the main rail for storage of the trolley and accordingly, the secondary rail is spaced the desired distance from the main rail. Interconnecting the main rail and the secondary rail is a switching rail removable into and out of operative relationship between the main and secondary rails such that a trolley wheel assembly may ride thereupon and be transferred from the main rail to the secondary rail.

In greater detail, a typical trolley system with which the present invention may be utilized will include most conventional arrangements. Thus, in such overhead trolley arrangements, there is provided a main rail supported by suitable means upon which trolleys are adapted to ride. The trolleys themselves may be of any suitable configuration; they generally include a pair of spaced wheel assemblies adapted to ride on the uppermost portion of the guide rail. The trolley will generally have a bar or other member upon which the workload or other material to be transported is carried, with support members extending from each wheel assembly to the bar or other member. The support members are preferably rotatably journalled such that the vehicle can follow a curved track.

According to the present invention, there is provided a secondary rail spaced from the main rail and which secondary rail is of a type or configuration substantially similar to the main rail-in other words, it may be any suitable conventional overhead rail type. A switching rail is operative to switch one or more wheel assembly of each trolley from the main rail to the secondary rail and in this respect, is movable into and out of operative relationship between the primary and secondary rails. Depending on the system, various arrangements may be employed for switching every second wheel assembly or as desired. Thus, for example, in one embodiment, two wheel assemblies may be allowed to pass on either the main or secondary rail with the following two assemblies being switched to the alternate rail. The switching rail may be pivotably mounted in one or more manners to permit the desired switching operation.

Means for provided for moving the switching rail into and out of operative relationship with the main rail. In one particular embodiment wherein the switching rail is pivotably connected to the secondary rail, a simple manual switching device may be employed. Thus, for example, a U-shaped engaging member may be provided to engage the underside of the switching rail and lift the same, as the result of a force applied, out of engagement with the upper surface of the main rail. Alternatively, other arrangements may be employed such as a piston driven arrangement, etc.

The secondary rail, in the storage area wherein the trolleys are to be stored, is spaced from the main rail a distance substantially equal to less than a trolley length depending on whether the trolleys are stored in a regular or diagonal mode.

The switching rail, as aforementioned, is adapted to move into an operative relationship with the main rail to divert a wheel assembly therefrom. As such, the switching rail is in juxtaposition to the upper surface of the main rail. Preferably, the switching rail is arranged such as to have an initial ascending portion followed by a descending portion terminating in its pivotable connection with the secondary rail. The advantages of this arrangement will be seen hereinafter in the description of the preferred embodiments.

In lieu of a manual switching operation, an automated arrangement may be employed. In such an embodiment, an actuating device may be mounted proximate one of the rails, preferably the secondary and/or switching rail, which device is adapted to be activated by the passing of a trolley or wheel assembly thereof. Conveniently, the device may be activated by a projection mounted on the wheel assemblies or alternatively, the device may be spaced a distance from the rail so as to be automatically activated by the wheel assemblies. The advantage of such an arrangement will be again shown in the description of the detailed embodiments.

Having thus generally described the invention, reference will be made to the accompanying drawings illustrating embodiments thereof, in which.

Figure 1:
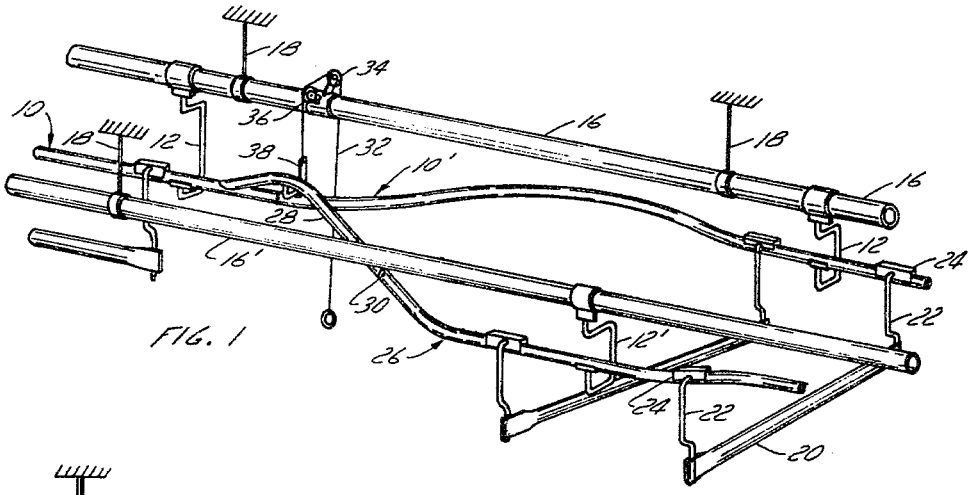
FIG. 1 is a perspective view of a first embodiment of a portion of a trolley storage and switching system.

Referring to the drawings in greater detail and by reference characters thereto, FIG. 1 illustrates a first embodiment of an overhead trolley storage system which includes a manually activated switching mechanism.

The overhead trolley storage system of FIG. 1 includes an overhead main guide rail 10 upon which the trolleys ride in a conventional manner. To this end, main guide rail 10 may be tubular in cross-section and as illustrated in the drawings, is supported from underneath by a plurality of generally C-shaped brackets 12, each bracket having a concave member 14 upon which main guide rail 10 is supported. At the opposed end of brackets 12 are a plurality of main supporting members generally designated by reference numeral 16 and which members 16 are suspended from a ceiling or like structure in any suitable manner; in FIG. 1, a plurality of straps 18 are employed therefor.

Each trolley consists of a main bar 20 upon which the work to be transported is placed or suspended from by suitable means. At opposed ends of bar 20 there is provided a hanger member 22 which is rotatably journalled in bar 20. At an opposed end of member 22 is a conventional wheel assembly 24 adapted to ride on main rail 10. In this respect, the trolleys illustrated are of the conventional type and may be adapted to the particular purpose for which they are to be used.

The trolley system is one wherein the trolleys operate on a single main rail 10. The present invention provides a mechanism for switching the individual trolleys and for storage of the same, either at a work station or as otherwise required when not in use.

The switching system includes a secondary rail 26 which is supported by hangers 12' from a supporting member 16' in the same manner as main rail 10.

In the storage or like area, secondary rail 26 is generally substantially parallel to main rail 10 with several deviations therefrom as will be discussed in greater detail hereinafter.

Extending from one end of secondary rail 26 is a switching rail generally designated by reference numeral 28. Switching rail 28 is hingedly connected to secondary rail 26 by means of a suitable mechanism 30, with the other end of switching rail 28 lying in juxtaposition to main rail 10 such that a wheel assembly 24 of a trolley will transfer to switching rail 28 when switching rail 28 is in the desired position.

Figure 2:
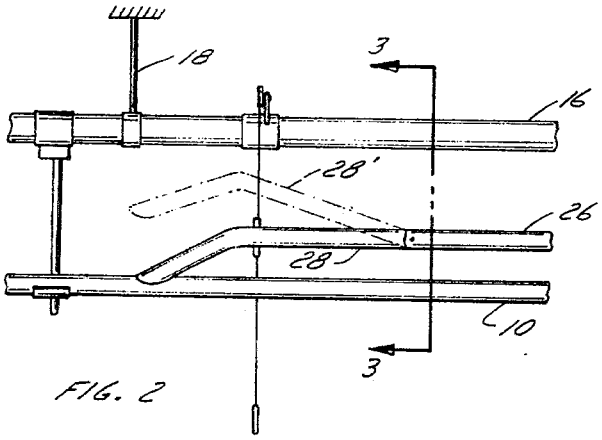
FIG. 2 is a side elevational view of the switching mechanism illustrated in FIG. 1.
Figure 4:
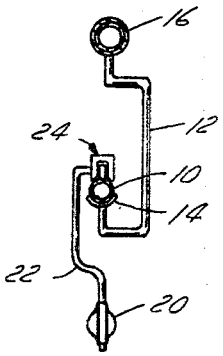
FIG. 4 is a cross-sectional view of a portion of the rail and trolley system of FIG. 1.
Figure 3:
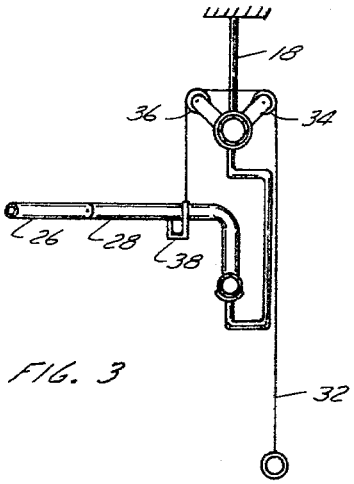
FIG. 3 is a cross-sectional view taken along the lines 3—3 of FIG. 1.

A switching mechanism for moving switching rail 28 into and out of juxtaposition with main rail 10 is provided. As shown in FIGS. 1 to 3, the mechanism may comprise a pulley 32 entrained about a pair of pulley wheels 34 and 36 which are mounted on means 16. A U-shaped member 38 is adapted to engage switching rail 28 when a downward force is applied to pulley 32 and lift the same to an inoperative position vis a vis main rail 10 as shown in dotted lines in FIG. 2.

Figure 5:
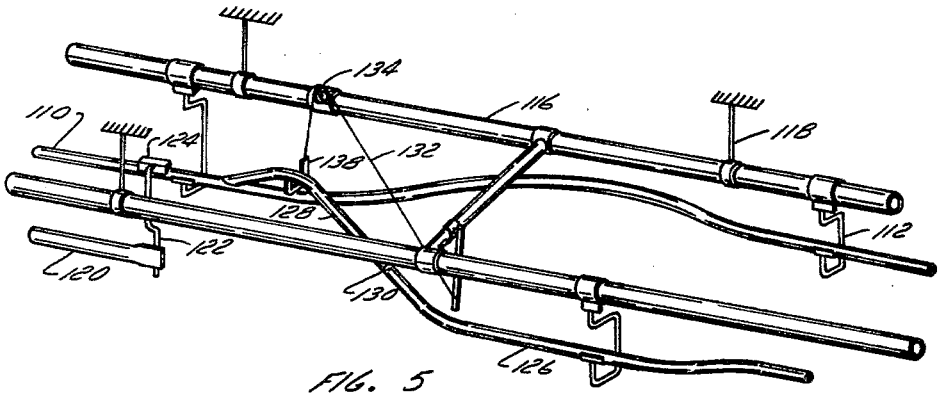
FIG. 5 is a perspective view of a second embodiment of a trolley storage and switching system which includes an automatic switching mechanism.
Figure 6:
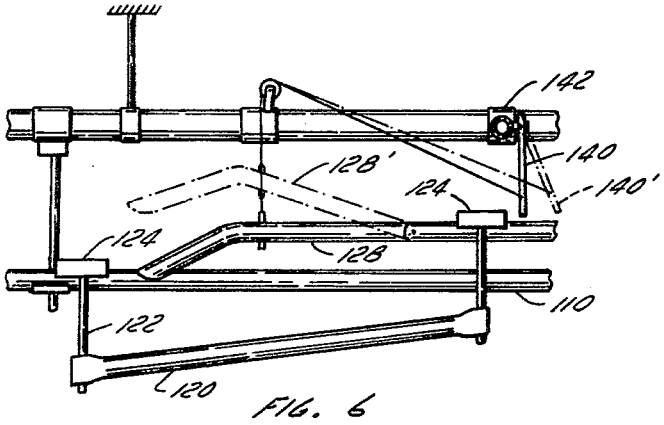
FIG. 6 is a side elevational view of the switching mechanism of FIG. 5.

A further embodiment of a switching mechanism wherein separation of adjacent trolleys is not required, is illustrated in FIGS. 5 and 6 and will now be referred to. In a manner similar to that shown in FIGS. 1 to 4, this embodiment includes a main rail 110 supported by C-shaped hangers 112. Support members 116 are suspended from straps 118. A similar form of trolley may likewise be employed having a main bar 120 supported by wheel assembly 124 through member 122 which is rotatably journalled with respect to bar 120.

The switching system of this embodiment includes a secondary rail 126 which again is generally parallel to a portion of main rail 110. The switching assembly, as in the previous embodiment, includes a switching rail 128 pivotably connected to secondary rail 126 as designated by reference numeral 130.

In this embodiment, there is provided a switching assembly having a pulley 132 entrained about a pulley wheel 134 and having secured to one end thereof a U-shaped member 138 adapted to engage switching rail 128 and move the same into and out of an operative relationship with main rail 110 as shown in FIG. 6. In this respect, there is provided an automated actuator comprising a member 140 which is pivotably mounted to a bracket 142. The other end of member 140 is placed in an operative position with respect to switching rail 126 such that the same will be actuated by a passing wheel assembly 124 to move pivotal member 140 to the position indicated by reference numeral 140' thereby raising switching rail 128 to the position indicated by reference numeral 128' to permit a trolley to continue passage on main rail 110. Thus, the operation of the switching assembly is automated and is activated by the passage of a trolley on secondary rail 126.

In both of the above-described embodiments, it will be noted that main rail 10 or 110, as the case may be, following the point of juxtaposition of switching rail 28 and 128 respectively, follows a curve "outwardly" with respect to the switching rail. Subsequently, the main rail bends inwardly, in the illustrated embodiment, to a further straight section. The switching rail has an initially upwardly inclined portion followed by a downwardly inclined portion to lie in the same plane as the main rail. Each secondary rail has a straight portion substantially parallel to the main rail and spaced therefrom by a distance substantially equal to a trolley length. Each secondary rail then bends inwardly towards the main rail and subsequently continues parallel thereto.

Figure 7:
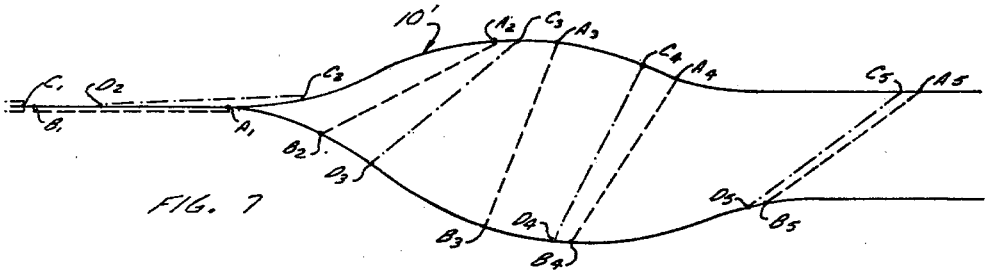
FIGS. 7 and 8 are schematic views illustrating two alternate ways of operating the described systems for storing trolleys.
Figure 8:
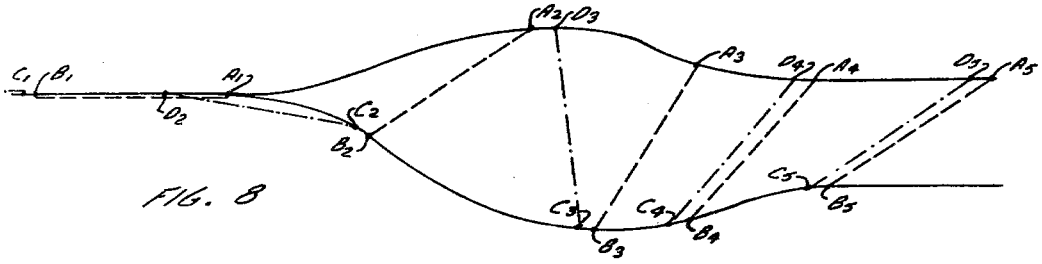

Turning to FIGS. 7 and 8, two different embodiments of the operation of the present invention are illustrated. Referring initially to FIG. 7, a schematic illustration of the operation of the trolley switching system of the present invention is shown. In this respect, the sequential movement of two trolleys, the first of which is designated A–B and the second of which is designated C–D, are shown as they move through a trolley switching and storage area such as shown in FIGS. 1 to 4.

Initially, trolley $A_1$–$B_1$, moving on main rail 10, continues through a curved portion 10' while switching rail 28 is lifted to its inoperative position. After passage of the front wheel assembly, switching rail 28 is lowered to its operative position whereby the rear or trailing wheel assembly will ride up on switching rail 28. The trolley will then assume the position shown in FIG. 7 of $A_2$–$B_2$. In this respect, it will be noted that leading end $A_2$ will tend to maintain a leading position due to an upwardly inclined portion, as shown in FIG. 1, present in switching rail 28.

When trailing end $B_2$ reaches the apex of switching rail 28, its downward descent will be accompanied by an increase in speed thereby enabling the trailing end to move at a faster rate to "catch up" to the relative position of the leading end—the configuration of the two rails permits this movement as shown in FIGS. 1 and 7. Thus, the trolley will then assume the position designated by $A_3$–$B_3$. At this point, the separation of main rail 10 from secondary rail 26 is at a maximum.

Subsequently, the separation of main rail 10 and secondary rail 26 diminishes and the leading end, which is still in a leading position, will move forward of the trailing end and assume the positions $A_4$–$B_4$ and subsequently, $A_5$–$B_5$. It will be noted that the trolley is thus stored in a diagonal position.

A subsequent trolley C–D is also schematically shown in FIG. 7 and as will be seen, following passage of the rear B of a preceding trolley, switching rail 28 is again raised such that leading end C will continue on main rail 10 as shown in FIG. 7 by $C_2$–$D_2$. In other respects, the trolley moves in the sequence as described with respect to trolley A–B. Thus, as may be seen, in this embodiment, the switching rail 28 is manually raised for each leading wheel assembly of each individual trolley and lowered to divert the trailing or rear wheel assembly onto secondary rail 26. The trolleys are then stored in the diagonal position as shown in FIG. 7.

If desired, the above sequence could be reversed in that the leading wheel assembly would ride on the switching rail while the trailing wheel assembly continues on the main rail. However, in both cases the operation is manual and adjacent trolleys must be separated by a distance sufficient to permit operation of the switching rail between the trailing end of a first trolley and the leading end of a subsequent trolley. However, this disadvantage can be overcome employing the configuration given above as will be seen from the following description with respect to FIG. 8.

Turning to FIG. 8, the operation of an embodiment similar to that shown in FIGS. 5 and 6 is illustrated in schematic form. Again, first and second trolleys are designated by reference characters A–B and C–D with A and C representing the initial leading or forward portions or wheel assemblies and reference characters B and D representing the trailing or rear ends and wheel assemblies.

An initial trolley is illustrated in the position $A_1$–$B_1$. The switching rail 128 is, at the moment, in a raised position (due to activation of the rail by a previous trolley) indicated by 128' in FIG. 6 to permit leading end A to continue on mail rail 110. Subsequently, the switching rail 128 is in a lower or operative position to permit trailing wheel assembly B to be diverted via switching rail 128 to secondary rail 126. The automatic operation of this switching will be evident hereinbelow.

Following the transfer of the rear wheel assembly to switching rail 128, the trolley then assumes a position indicated by $A_2$–$B_2$. As the trailing or rear wheel assembly rides along switching rail 128, the immediately following leading wheel assembly of a subsequent trolley will also be diverted by switching rail 128. Thus, the two trolleys will assume the orientation shown by $A_2$–$B_2$ and $C_2$–$D_2$.

Subsequently, leading end A moves along main rail 110 and trailing end B along rail 128 to assume the position indicated by $A_3$–$B_3$. Trolley C–D follows and in so doing, rear end B will trip or activate switching member 140 to move the same to position 140' and thus raise switching rail 128. Leading or front end C of trolley C–D will maintain the switching rail 128 in an inoperative position and switching member 140 is positioned such that the activation of the same will permit the passage of the rear of a second trolley and the leading end of a subsequent trolley to continue on main rail 110. Thus, rear wheel assembly D of trolley C–D continues on main rail 110 due to activation of the switching assembly by rear wheel assembly B of trolley A–B. A subsequent front wheel assembly of a following trolley will also continue on main rail 110 similar to trolley A–B. After passage of the rear and front wheel assemblies respectively of two adjacent trolleys, switching rail 128 is again placed in an operative relationship to main rail 110. As a result of the above, two adjacent trolleys then assume the positions indicated by $A_3$–$B_3$ and $C_3$–$D_3$. Subsequently, the trolleys assume the positions indicated by $A_4$–$B_4$ and $C_4$–$D_4$. It will be noted that the rear wheel assembly D of trolley C–D has now become the leading end of the trolley due to the configuration of the main or primary rail 110 and secondary rail 126. Finally, the trolleys are stored in the position indicated by $A_5$–$B_5$ and $C_5$–$D_5$; this position being substantially equivalent to that shown in FIG. 7. However, the passage of the trolleys has been completely automatic without any attendant being required to manually switch the trolleys.

If desired, the trolleys could be stored in a parallel position employing the arrangement of either FIG. 7 or 8 wherein the trolleys are substantially perpendicular to the rails—this would require a separation of the main and secondary rails by a distance substantially equal to the trolley length.

Figure 9:
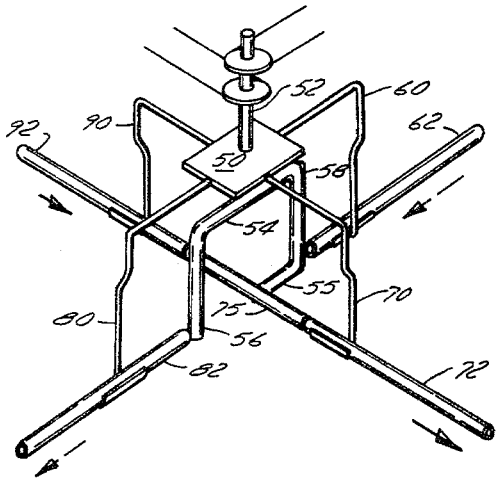
FIG. 9 is a perspective view of a crossing assembly switch useful in a trolley system.

Referring to FIG. 9, a cross-over device is illustrated. This cross-over device may be employed in an overhead rail system of the type previously or any other suitable overhead rail system. The device includes a plate 50 having supporting arms 60, 70, 80 and 90 extending therefrom at 90° angles with respect to each other. Thus, supporting arms 60 and 80 extend outwardly in opposed directions as do arms 70 and 90. Each arm supports, through conventional means, an overhead rail section 62, 72, 82 and 92 respectively. Rotatably journalled in plate 50 is a shaft 52 which in turn is connected to a switching member having a first upper horizontal portion 54, which, at opposed ends thereof, has arms 56 and 58 extending in a generally downward direction. At the bottom of arm 58 which lies in the general horizontal plane of rail sections 62, 72, 82 and 92, is provided a horizontal section 55 which supports a tubular rail section 75. Shaft 52 has a pulley arrangement such that the same may be located whereby rail section 75 may be moved so as to form a continuous rail between sections 92–72 and 62–82. Thus, suitable sensing means can be activated by the approach of a trolley and cause shaft 52 to rotate appropriately through the drive pulleys.

The above cross-over device may be employed naturally, for angles other than 90° with respect to each other. Furthermore, as will be seen, when the cross-over device is operative for the passing of a trolley in one direction, and in the position illustrated in FIG. 9, arms 56 and 58 function as "stoppers" to prevent a trolley passing in the wrong direction. Thus, for example, it will be understood that those skilled in the art can combine various features of the described embodiments. The embodiment shown in FIGS. 1 and 7 may, for example, not have the sloping switching rail as this is not essential in the manual mode. It is, however, a preferred feature and particularly preferred in the automatic mode. Furthermore, it will be understood that different combinations such as employing the switching means on the main rail section may be utilized.

Figure 10:
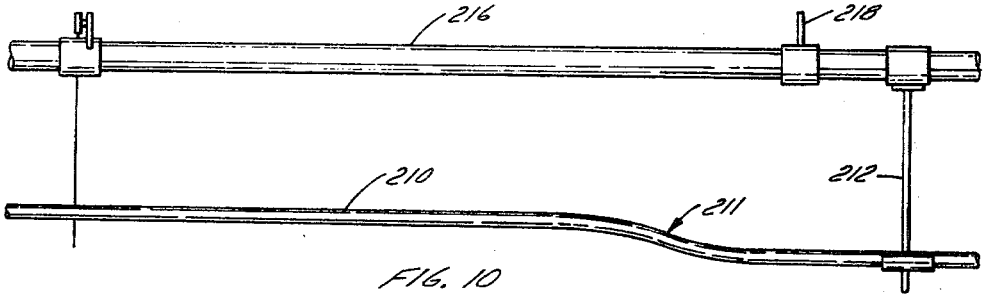
FIG. 10 is a side elevational view of a portion of the main rail according to one embodiment of the invention.

Referring to FIG. 10, there is illustrated a section of a main rail 210 which is supported by a C-shaped hanger 212 depending from support member 216 suspended by strap member 218. Main rail 210 includes a downwardly sloped section 211; section 211 is preferably situated in the initial portion of the main rail proximate the location of the switching rail. Thus, referring to FIG. 7, downwardly sloping portion 211 would be situated in the area between $C_2$ and $A_4$ and most preferably, in the area between $A_2$ and $C_4$. The downwardly sloping portion 211 permits the trolley to maintain the desired orientation. If desired, an initially upwardly sloping section may be combined with the downwardly sloping section.

Figure 11:
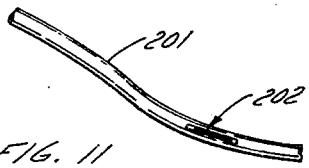
FIG. 11 is a top plan view of a stop member used in the invention.
Figure 12:
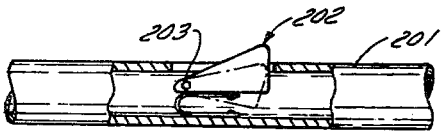
FIG. 12 is a side elevational view, partially in section, of the stop member illustrated in FIG. 11.

Referring to FIG. 11, there is shown a rail section 201 which may be either a primary or secondary rail or indeed, a switching rail portion. Within wheel 201 is a stop member 202 which, as best seen from FIG. 12, is a triangularly shaped member pivoted about pivot point 203. Member 202 is resiliently biased upwardly by suitable means (such as spring means) to maintain the position shown in FIG. 12, and which permits the passage of a wheel assembly in a left to right direction as seen in FIG. 12. Member 202 does function, however, to prevent passage of a wheel assembly in the opposite direction.

Figure 13:
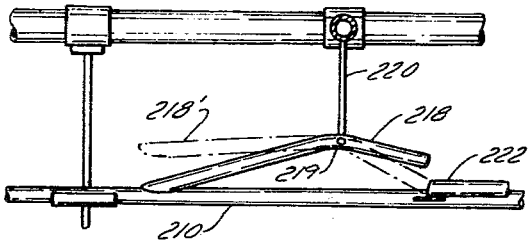
FIG. 13 is a side elevational view of an alternative arrangement of the switching rail.
Figure 14:
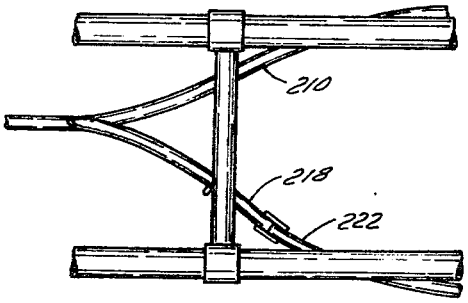
FIG. 14 is a top plan view of the arrangement of FIG. 13.

Referring to FIGS. 13 and 14, an alternative switching rail assembly is shown. Thus, there is provided a switching rail 218 pivoted about point 219 intermediate the ends of the rail 218. A suitable hanger 220 is provided for pivot point 219 whereby the rail can pivot to the position indicated in dotted lines by reference numeral 218'. Thus, as will be seen, switching rail 218 can pivot to direct a wheel assembly to a secondary rail 222 or alternatively, to allow the same to continue on main rail 210. In this respect, the rail is preferably designed to be weight actuated such that it is normally in the position shown in FIG. 13. A first wheel assembly will be diverted from main rail 210 upwardly along switching rail 218 until it passes pivot point 219 whereby the weight of the assembly will bear on the other end of the rail causing the same to resume the position designated by reference numeral 218'. Thus, a second wheel assembly would be permitted to continue on main rail 210.

It will be understood that the above-described embodiments are for purposes of illustration only and that changes and modifications may be made thereto without departing from the spirit and scope of the invention.

I claim:

1. A trolley storage system for storing a plurality of individual trolleys, each trolley having a leading wheel assembly and a trailing wheel assembly; the system comprising: a main generally horizontal rail having an upstream portion and a storage portion; a secondary generally horizontal storage rail spaced from the storage portion of the main rail and forming a storage area with the storage portion of the main rail for trolleys; a switching rail at the entrance to the storage area and movable between a first closed position where it connects the upstream portion of the main rail to the secondary rail and a second open position where it disconnects the upstream portion of the main rail from the secondary rail; means for moving the switching rail between its first and second position; said switching rail moving means including operator means located in the storage area and positioned to be actuated by the leading end of a leading trolley in the storage area before the trailing end of the same trolley reaches the entrance of the storage area, the operator means controlling the moving means to automatically allow the trailing wheel assembly of the leading trolley, and the leading wheel assembly of an adjacent trailing trolley, to enter the storage area on the other rail from the rail in the storage area already carrying the leading wheel assembly of the leading trolley.

2. A trolley system as claimed in claim 1 wherein the switching rail is pivotably mounted at one end to the secondary rail, the other end of the switching rail being shaped to abut on the main rail when in the first closed position, the moving means including means connected to the switching rail to lift the other end of the switching rail off the main rail when in the open position, the operator means comprising lever means actuated by the leading end of the leading trolley and operatively connected to the lift means.

3. A trolley system as claimed in claim 2 wherein the storage portion of the main rail, and the secondary rail, diverge from each other moving away from the entrance to the storage area to a maximum separation equal to the distance between the leading and trailing wheel assemblies of a trolley, and then converge and become parallel to each other to store trolleys diagonally to the rails.

* * * * *